US005908032A

United States Patent [19]

Poindexter et al.

[11] Patent Number: 5,908,032

[45] Date of Patent: Jun. 1, 1999

[54] METHOD OF AND APPARATUS FOR EXPANDING TOBACCO

[75] Inventors: Dale Bowman Poindexter, East Bend; Russell Dean Barnes, Belews Creek; Hoyt Sturdivant Beard, Winston-Salem; Keith Rowan Guy, Winston-Salem; Ricky Harris Laurence, Winston-Salem; Harold Eugene Richardson, Winston-Salem; Tony Dean Stewart, Winston-Salem; Douglas Edwin Wilhelm, Winston-Salem, all of N.C.

[73] Assignee: R.J. Reynolds Tobacco Company, Winston-Salem, N.C.

[21] Appl. No.: 08/694,963

[22] Filed: Aug. 9, 1996

[51] Int. Cl.[6] ..... A24B 3/18

[52] U.S. Cl. ..... 131/291; 131/296; 406/195; 406/173

[58] Field of Search ..... 406/195, 173, 406/87, 94, 86, 88, 89; 131/296, 291, 290, 292, 300

[56] References Cited

U.S. PATENT DOCUMENTS

| | | | |
|---|---|---|---|
| 4,146,195 | 3/1979 | Brooks | 243/38 |
| 4,167,191 | 9/1979 | Jewell et al. . | |
| 4,315,515 | 2/1982 | Mills, III . | |
| 4,366,825 | 1/1983 | Utsch et al. . | |
| 4,418,706 | 12/1983 | Kim et al. . | |
| 4,483,352 | 11/1984 | Egri . | |
| 4,523,598 | 6/1985 | Weiss et al. . | |
| 4,528,995 | 7/1985 | Korte et al. . | |
| 4,697,604 | 10/1987 | Brown et al. . | |
| 4,911,182 | 3/1990 | Dennis . | |
| 4,915,547 | 4/1990 | Cahill et al. | 406/87 |
| 5,259,403 | 11/1993 | Guy et al. | 131/291 |
| 5,533,528 | 7/1996 | Wallace et al. . | |
| 5,582,193 | 12/1996 | Fischer et al. | 131/296 |

FOREIGN PATENT DOCUMENTS

| | | |
|---|---|---|
| 0 285 811 | 10/1988 | European Pat. Off. . |
| PCT/US95/10801 | 2/1996 | WIPO . |

OTHER PUBLICATIONS

European Search Report dated Dec. 15, 1997.

*Primary Examiner*—John G. Weiss
*Assistant Examiner*—Charles W. Anderson

[57] ABSTRACT

A method of and an apparatus for expanding tobacco, particularly tobacco impregnated with solid carbon dioxide are disclosed. The apparatus comprises an arcuate, generally C-shaped duct for conveying the tobacco material in a hot gaseous medium to sublimate the solid carbon dioxide and expand the tobacco. The duct has a non-circular cross-section, preferably a rectangular cross-section, with a high width-to-depth ratio and an increasing depth from the inlet to an intermediate portion of the duct then a decreasing depth from the intermediate portion to the outlet of the duct. A winnower device infeeds the tobacco material into the duct adjacent the throat of a venturi section connected to the inlet of the conveying duct. A tangential separator with an adjustable baffle at the inlet thereof for controlling velocity in the separator is used to separate the expanded tobacco from the gaseous medium.

31 Claims, 2 Drawing Sheets

10
12
14
16
18
20
22
24
26
28
30
32
34
35
36
38
40
42
44
46
48
50
52
54
56
58
60
62
70
72
74
76
78
79
80
82
84
86
88
2
3
4
C
D
R1
R2

16
34
35
70
72
74
76

METHOD OF AND APPARATUS FOR EXPANDING TOBACCO

FIELD OF THE INVENTION

The present invention relates to the expansion of tobacco useful in the manufacture of cigarettes, and more particularly to a method of and an apparatus for the volumetric expansion of cut tobacco filler.

BACKGROUND OF THE INVENTION

The volumetric expansion of tobacco material, such as cut filler, to increase its filling capacity is well-known in the art of tobacco processing. One method for the volumetric expansion of tobacco material involves impregnation of the tobacco material with liquid carbon dioxide ($CO_2$), subjecting the $CO_2$ impregnated tobacco material to conditions sufficient to convert substantially all of the liquid $CO_2$ to solid $CO_2$, then vaporizing the solid $CO_2$ in the impregnated tobacco material so as to expand the tobacco. This process has been referred to in the art as a dry ice expanded tobacco process or "DIET" process. An example of the DIET process is disclosed in U.S. Pat. No. 5,259,403 assigned to the assignee of the present invention, the disclosure of which is incorporated herein by reference.

The DIET process is typically practiced by introducing particles or "clumps" of solid $CO_2$ impregnated tobacco material into a heated gas stream which is accelerated by a venturi. The heated gas conveys the tobacco material through a duct and sublimates or volatilizes the solid $CO_2$ to cause expansion of the tobacco material. The conveying duct, sometimes referred to as a sublimator, is usually in the form of a vertical or upwardly inclined tube or pipe with a cylindrical or rectangular cross-section. The particles or clumps of impregnated tobacco material are entrained in the sublimator tube until the solid $CO_2$ is substantially completely sublimed or volatilized. From the sublimator, the expanded tobacco material is transported to a separator apparatus, such as a tangential separator, cyclone separator or the like, where it is separated from the hot gas stream, tobacco volatiles and dust.

According to the apparatus disclosed in the aforesaid U.S. Pat. No. 5,259,403, the conveying duct or sublimator is in the form of a vertically extending duct having a circular cross-section that increases from a smaller diameter at the inlet thereof to a larger diameter at an intermediate portion thereof. Advantageously, that construction provides a reduced velocity section of the sublimator which prevents transport of large clumps of solid $CO_2$ impregnated and unexpanded tobacco material into the tangential separator.

Other conventional sublimator apparatuses for practicing the DIET process have a number of limitations or deficiencies. For example, in many sublimators, the inlet valve or air lock for introducing the clumps of solid $CO_2$ impregnated tobacco material into the duct often admits excessively large incremental quantities of material into the heated gas stream at the duct inlet at a relatively slow rate which results in a nonuniform distribution of tobacco material in the sublimator. Poor scattering and lack of entrainment of the impregnated tobacco particles and clumps upon entering the heated gas stream and sublimator result in variable dwell times and variations in the amount of heating and expansion of the tobacco particles. As a result, some particles are darkened and burnt by overheating and others are light and only partially expanded. This is especially problematic with large clumps of tobacco material which tend to fall to the bottom of the duct where there is poor air flow and poor heat exchange in the prior art apparatuses.

The use of 90° elbows and other angled duct sections to minimize the floor area of a plant taken up by a DIET apparatus results in excessively non-uniform heated gas flows through the duct and greater breakage of the tobacco particles because of the abrupt direction changes at the elbows and through the use of impingement plates. Non-uniform gas flows result in "jetting" or "roping," i.e., one region flowing at a greater velocity than another, causing significant dwell time variations and uneven heating. Excessive gas flow velocity also causes breakage of tobacco strands. Some duct designs experience significant gas recirculation zones which also adversely affect dwell time of the tobacco material in the sublimator.

To achieve maximum filling capacity or filling power of the expanded tobacco product of the sublimator, the solid $CO_2$ impregnated tobacco material must be expanded to the greatest extent possible without overheating or excessive breakage of the tobacco strands. It would be desirable therefore to provide a sublimator apparatus and a method of expanding tobacco to a maximum filling capacity with no overheating and minimum breakage of the tobacco strands while maximizing the tobacco throughput of the apparatus.

SUMMARY OF THE INVENTION

In view of the foregoing limitations and shortcomings of the prior art devices, as well as other disadvantages not specifically mentioned above, there is still a need in the art to improve the processing of tobacco in a DIET-type process. The present invention is directed to an improved method of and an apparatus for increasing the filling capacity of tobacco cut filler by expanding it in a DIET process. The method and apparatus of the invention overcome most, if not all, of the disadvantages of the prior art DIET methods and apparatus as is more fully described hereinafter.

According to the method and apparatus aspects of the invention, the sublimator apparatus comprises an arcuate, generally C-shaped or substantially semicircular sublimator duct with large sweeping radii. The C-shaped duct has a non-circular cross-section, preferably a rectangular cross-section with a high width-to-depth (W/D) ratio of about 5 to 2. A high W/D ratio advantageously reduces the velocity gradient across the depth of the rectangular cross-section and provides substantially uniform flow through the sublimator at any given cross-section with few, if any, recirculating flows. The C-shaped duct also has a gradually diverging (increasing) then gradually converging (decreasing) depth. The gradually increasing depth causes the flow velocity to drop smoothly and uniformly from the generally horizontal lower duct section at the sublimator inlet to the generally vertical intermediate duct section to avoid conveyance of large clumps of tobacco material to the sublimator outlet before complete sublimation of the solid $CO_2$. From the intermediate section, the duct converges or decreases in depth to the generally horizontal upper duct section at the outlet so as to accelerate the expanded tobacco particles into a tangential separator. The large radii of the sublimator duct sections provide a gradual curve in the duct so as to form an arcuate flow path with a continuously varying flow direction from inlet to outlet which avoid the abrupt flow direction changes of angled duct sections, especially 90° elbow sections, which cause breakage of the tobacco strands.

A venturi section is provided at the upstream or inlet end of the sublimator duct for accelerating the hot gas stream into the sublimator. This venturi section includes a long, shallow-angled inlet pipe for shaping the profile of the gas flow so as to sweep or wash the bottom of the lower duct section to keep the larger clumps of tobacco moving through the duct. The venturi inlet pipe also provides a transition from a circular cross-section pipe to a non-circular, preferably rectangular, cross-section of the sublimator duct.

Infeed of the solid $CO_2$ impregnated tobacco material into the duct is accomplished by a winnower-type device rather than by a rotary air lock as is common in the prior art. The winnower inlet device is positioned just downstream of the throat of the venturi at which the cross-sectional area of the venturi is minimum. Instead of merely dropping the impregnated tobacco material into the venturi section by force of gravity, the winnower is rotated at a relatively high speed so that its vanes accelerate the impregnated tobacco particles and clumps transversely across substantially the entire depth of the hot gas stream passing through the venturi section. This effects better scattering and dispersion of the tobacco material into the hot gas stream than is possible with the gravity feed of a rotary air lock. Although the higher rotational speed of the winnower device reduces the quantity of tobacco material incrementally introduced into the venturi section as compared to a rotary air lock, it increases the frequency of each incremental quantity of tobacco material introduced so that total infeed volume can be maintained at the same or a greater level as an infeed device with a rotary air lock.

From the outlet of the upper duct section, the expanded tobacco particles flow into a tangential separator where the hot gas stream is separated from the expanded tobacco for recycling through the system after being reheated to the required processing temperature and reconditioned with water, air or other gases. In a further improvement according to the invention, an adjustable baffle is provided at the inlet to the tangential separator for regulating the gas velocity entering the tangential separator so as to maintain maximum efficiency of the separation of the expanded tobacco particles from the gas stream. The adjustable baffle is operated in cooperation with the volume control of the fan or blower which supplies the heated gas to the inlet of the venturi section of the sublimator apparatus.

The above-described features of the present invention advantageously make possible an improved dispersion of the impregnated tobacco particles and more uniform flow characteristics in the sublimator duct. The result is greater expansion efficiency and reduced heating of the tobacco leading to higher yields of expanded tobacco using the process and apparatus of the present invention. Reduced breakage of the tobacco particles owing to the absence of abrupt changes in flow direction in the apparatus of the present invention reduces the generation of tobacco dust and reduced over-heating of the tobacco particles which also improves the yield of the expanded tobacco product of the apparatus.

With the foregoing and other advantages and features of the invention that will become hereinafter apparent, the nature of the invention may be more clearly understood by reference to the following detailed description of the invention, the appended claims and the several views illustrated in the drawings.

DETAILED DESCRIPTION OF THE INVENTION

Figure 1:
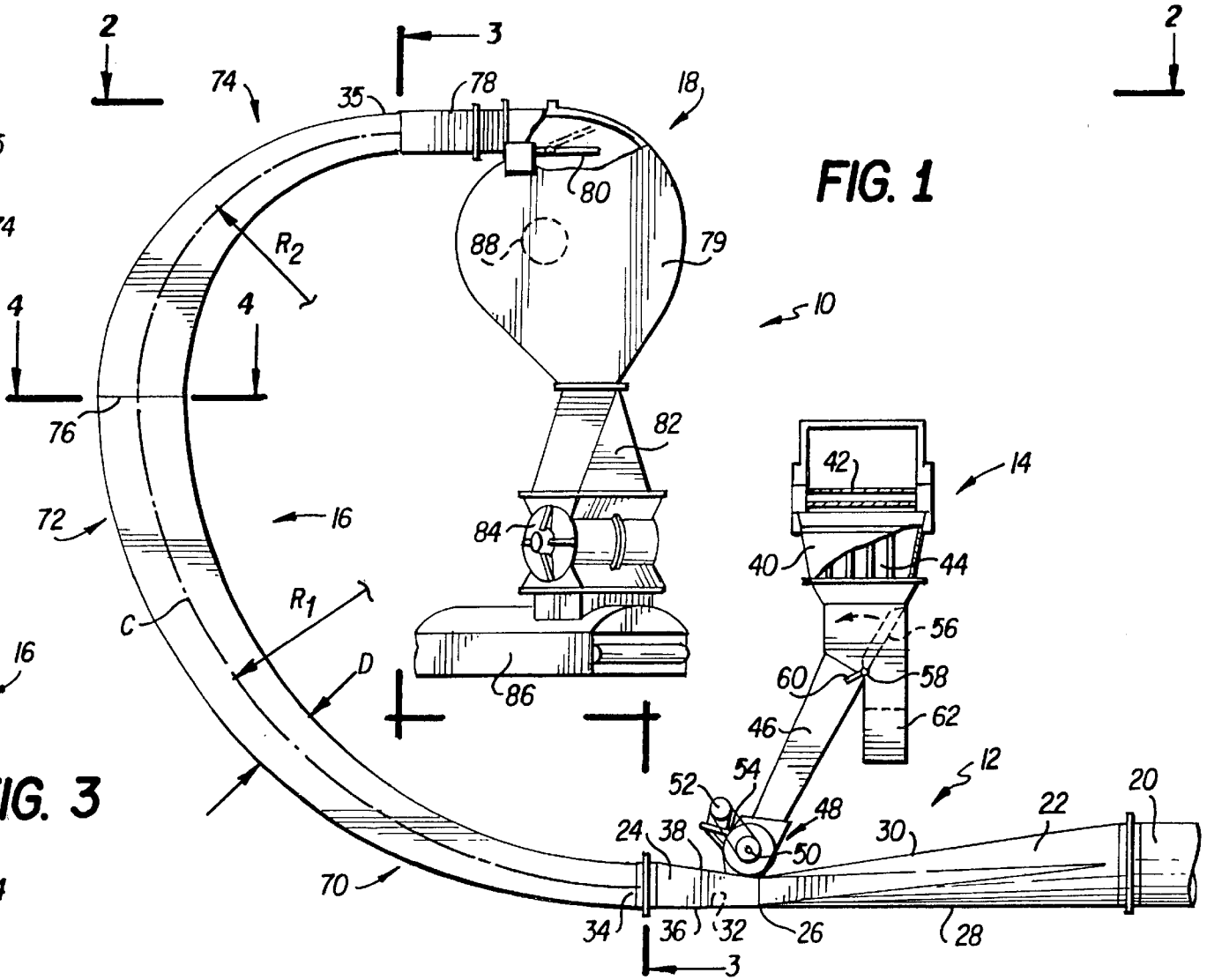
FIG. 1 is a side elevation view, partly broken, of the DIET sublimator apparatus of the present invention.
Figure 3:
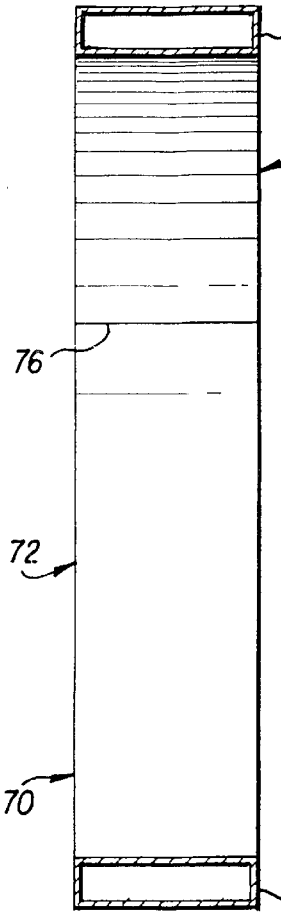
FIG. 3 is a cross-sectional view of the sublimator duct of the apparatus of the invention taken along line 3—3 in FIG. 1.

Referring now to the drawings, there is illustrated in FIG. 1 a DIET sublimator apparatus according to the present invention which is designated generally by reference numeral 10. Generally, apparatus 10 comprises a venturi section 12, a tobacco infeed device 14, a sublimator duct 16 and a tangential separator 18 as more fully described hereinafter.

In one specific embodiment of the invention, a cylindrical inlet pipe 20 having a diameter of about 28 inches supplies a high temperature gas to the apparatus 10. The gas may consist of air, water (steam), $CO_2$ and, if the gas includes recycled and reheated gas from the tangential separator 18, tobacco volatiles. Suitable gases for use in the DIET process are described in the aforesaid U.S. Pat. No. 5,259,403. Flow rate of the high temperature gas for the described embodiment may be in the range of about 30,000 cfm to about 36,000 cfm, and preferably about 34,000 cfm with a gas velocity at the inlet to the venturi section 12 of about 8,000 fpm.

Figure 2:
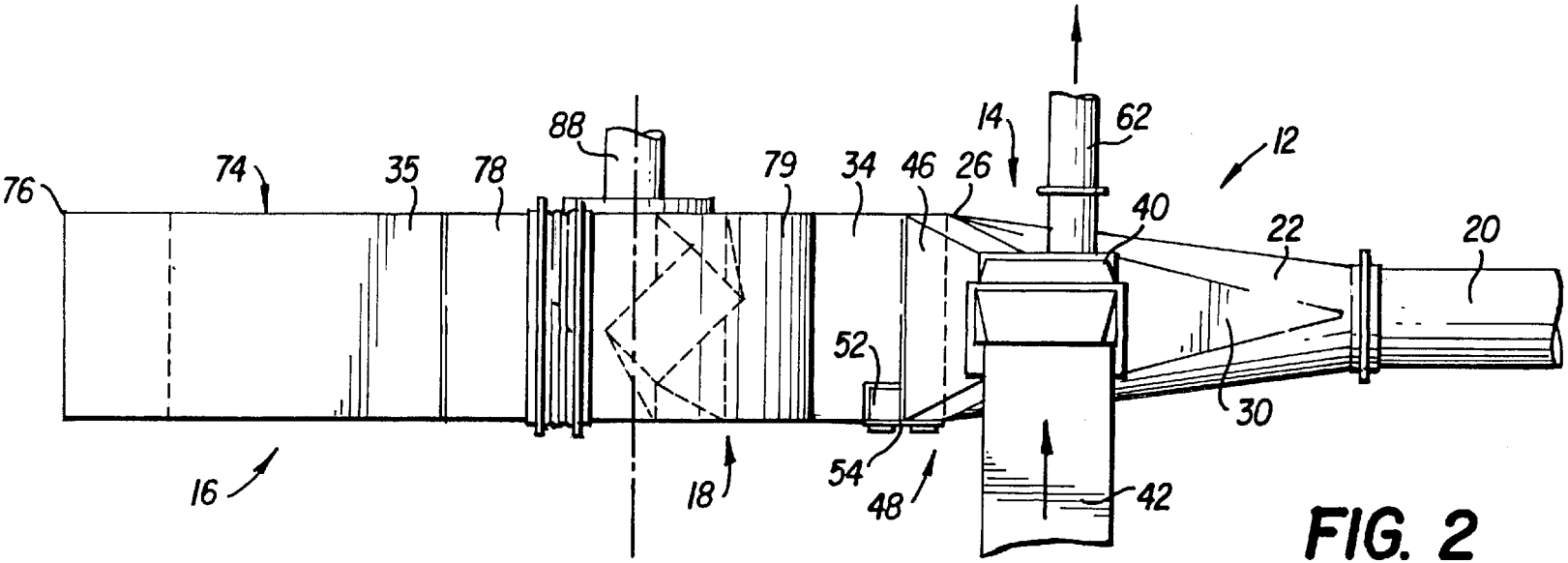
FIG. 2 is a top plan view of the DIET sublimator apparatus as viewed from line 2—2 in FIG. 1.

As is best seen in FIGS. 1 and 2, the venturi section 12 includes a venturi inlet tube 22 and a venturi outlet tube 24. Inlet tube 22 provides the transition from the cylindrical inlet pipe 20 to a rectangular cross-section at the throat 26 of the venturi. The rectangular cross-section at the throat 26 has a high width-to-depth (W/D) ratio and in the described embodiment is about 7:1 for a duct width of about 60 inches. Inlet tube 22 is substantially elongated in its longitudinal direction with the bottom surface 28 thereof extending in a substantially horizontal plane. The top surface 30 of the inlet tube 22 is downwardly inclined at a shallow angle of about 9° so that the hot gases flowing through the tube have a slight downward velocity component enabling the gases to "sweep" or "wash" the interior bottom surface 32 of the venturi outlet tube 24.

Outlet tube 24 of the venturi section 12 is approximately one-third the length of the inlet tube 22 and diverges from the throat 26 of the venturi section to the inlet 34 of the sublimator duct 16. The bottom surface 36 of the outlet tube is a horizontal planar surface coplanar with bottom surface 28 of the inlet tube 22. The top surface 38 of outlet tube 24 diverges toward the sublimator duct inlet 34 at an upwardly inclined angle of about 8°.

The tobacco infeed device 14 comprises an infeed hopper 40 to which solid $CO_2$ impregnated tobacco material is fed via a conveyor 42. A plurality of vertical diversion baffles 44 are provided in the hopper 40 for spreading the impregnated tobacco material across the width of the hopper 40. From hopper 40, the impregnated tobacco passes into a forwardly inclined infeed chute 46 which diverges outwardly to the full width of the venturi section 12 (FIG. 2).

At the bottom of the chute 46 a winnower device 48 is located for introducing the impregnated tobacco into the venturi section immediately downstream of the throat 26. Winnower device 48 comprises a rotary shaft 50 to which a plurality of radial vanes (not shown) are mounted. Drive motor 52 is connected to shaft 50 at a relatively high speed, e.g., about 70 rpm, compared to a rotary air lock. The winnower device 48 opens into the venturi section 12 by means of a rectangular opening at the bottom thereof.

In the event it is desired to interrupt the supply of impregnated tobacco to the venturi section 12, a diverter plate 56 is pivotably mounted on a shaft 58 at the upper end of chute 46. Plate 56 can be manually pivoted by means of handle 60 in the counterclockwise direction as shown by the arrow to divert the supply of impregnated tobacco into an outlet duct 62 for collection and recycling if desired.

The inlet 34 of sublimator duct 16 is connected to the venturi outlet tube 24 to receive the hot gas flow in which the impregnated tobacco is entrained. Sublimator duct 16 has a non-circular, preferably rectangular cross-section and is generally C-shaped in side elevation with the center line C thereof being defined by two large radii $R_1$ and $R_2$ forming an arcuate flow path. In the described embodiment, those radii $R_1$, $R_2$ are about 15 feet and 9 feet, respectively. The duct 16 comprises three processing zones or sections, namely, a generally horizontal lower inlet section 70, a generally vertically extending intermediate section 72 and a generally horizontal upper outlet section 74. As best shown in FIG. 1, the depth D of the duct 16 gradually increases (diverges) from the inlet 34 to a horizontal joint 76 at which the transition from radius $R_1$, to radius $R_2$ occurs. This depth divergence for a constant width duct causes a reduction in flow velocity from inlet 34 to joint 76. From plane 76 to the outlet 35 of duct 16 the depth D of the duct 16 decreases (converges). The converging depth from joint 76 to duct outlet 35 causes an increase in flow velocity. As is clear from the showing of FIG. 1, the flow direction through the duct changes by 180° from the inlet 34 to the outlet 35.

Outlet 35 of duct 16 is connected to the inlet 78 of tangential separator 18 which has a housing 79 with a width equal to the width of duct 16. Tangential separator 18 has an adjustable baffle 80 pivotally mounted adjacent the inlet thereof for adjusting the velocity of flow through the separator. Baffle 80 may be manually or automatically positioned by manual or automatic positioning means (not shown). The expanded tobacco product is forced radially outwardly in the separator and eventually falls into exit chute 82 at the bottom of separator 18. At the outlet of exit chute 82 the tobacco product falls into a rotary air lock 84 from which it is deposited onto a covered conveyor 86 for cooling prior to reordering. Exit chute 82 has a 45° twist so that conveyor 86 can be conveniently directed away from interference with the sublimator duct 16.

Waste gases from the tangential separator 18 exit the separator housing 79 via a gas return duct 88. The spent gas from duct 88 contains tobacco volatiles as well as some tobacco dust or fines. Preferably, the fines are removed from the gas stream prior to reheating so as to avoid any possible combustion of the fines. After removal of the fines, the gas is reheated and recirculated to the gas inlet pipe 20.

Operation of the DIET process of the invention is described below with reference to one specific embodiment of the apparatus 10, it being understood that the invention may be practiced using operating parameters of temperatures, flow rates, velocities, sizes, etc., other than those specifically described herein. Referring again to FIG. 1, a heated gas consisting of steam, air, $CO_2$ and tobacco volatiles is supplied to a 28 inch diameter inlet pipe 20 at a flow rate of about 34,000 cfm and at a temperature of about 650° F. Velocity of the heated air at the inlet of the venturi section 12 is about 8,200 fpm. The venturi inlet tube 22 has a length of about 11 feet and transitions from the 28 inch diameter inlet pipe 20 to a rectangular duct at the venturi throat 26 having a depth of 9 inches and a width of 60 inches. Gas velocity at the throat 26 is about 9,300 fpm. The venturi outlet tube 24 gradually increases in cross-section to a depth of 15 inches at the inlet 34 of the sublimator duct 34 with a gas velocity of about 5,600 fpm. Gas flow through inlet tube 22 sweeps or washes the bottom interior surface 32 of the outlet tube and prevents any large clumps of impregnated tobacco from collecting in the venturi section.

Solid $CO_2$ impregnated tobacco which has been declumped is conveyed into hopper 40 by conveyor 42 where it is distributed uniformly across the infeed chute 46 from which it passes into the winnower device 48. The vanes of winnower device 48 accelerate the tobacco particles into the high velocity gas stream at a sufficient velocity to disperse the particles over substantially the entire depth and width of the venturi outlet tube 24 from which they pass into the sublimator duct 16.

As the tobacco particles pass through the lower portion of the duct 16 there is a gradual redirection of the flow from a generally horizontal direction in section 70 to a generally vertical direction in section 72 and a reduction in gas flow velocity at the joint 76 to about 2,700 fpm. At joint 76, the depth of the duct is about 31 inches or about twice the cross-sectional area of the inlet 34. This reduction in velocity in the intermediate section 72 prevents any clumps of impregnated tobacco from being carried out of the duct and into the separator unexpanded. The gas flow velocity then increases because of the gradual decrease in duct depth to about 14 inches at the outlet 35 of duct 16 to a velocity of about 6,000 fpm to accelerate the expanded tobacco into the tangential separator 18. Advantageously, the residence time of the expanded tobacco particles in the duct is decreased by increasing the outflow velocity. This minimizes the possibility of conveying out unexpanded tobacco. Temperature of the heated gas is about 550° F. at the inlet to the tangential separator.

By appropriate control of the adjustable baffle 80 in the tangential separator, as well as control of the overall flow volume into the system, adjustments may be made to residence time of the tobacco material in the system and in the separation efficiency of the tangential separator.

Figure 4:
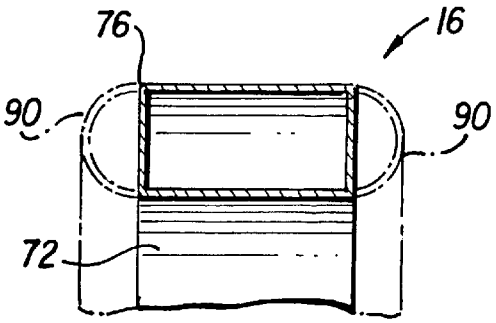
FIG. 4 is a cross-sectional view of the sublimator duct taken along line 4—4 in FIG. 1.

It will be appreciated from the foregoing description that the large radius arcuate flow path of the present invention advantageously eliminates abrupt direction changes of the tobacco material flow to minimize breakage of the tobacco strands and generation of excessive fines or tobacco dust. The C-shaped sublimator duct also reduces the floor space needed for the system of the invention when compared with the inclined sublimator ducts disclosed, for example, in U.S. Pat. Nos. 4,697,604 and 4,911,182. In addition, because the tangential separator can be located in close proximity to the infeed device (FIG. 1) the C-shaped sublimator duct of the invention occupies substantially the same floor space as a comparable system which employs a vertically disposed sublimator duct with oppositely directed 90° elbows, such as those ducts disclosed in U.S. Pat. No. 4,366,825 and International Publication No. WO 96/05742. While the duct 16 is shown and described as having a rectangular crosssection, other non-circular cross-sections are possible, such as an ovoid cross-section shown by the dashed lines 90 in FIG. 4. Such a cross-section is defined in International Publication No. WO96/05742, the disclosure of which is incorporated herein by reference.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. Apparatus for expanding tobacco with a gaseous medium comprising a conveying duct for conveying the tobacco with the gaseous medium, said duct having an inlet and an outlet, said duct being gradually curved from said inlet to said outlet so as to have a generally C-shape in side elevation, means connected to the duct inlet for supplying the gaseous medium to the duct at a given flow rate, said supplying means comprising a tubular venturi section having a throat, said venturi section having a venturi inlet tube and a venturi outlet tube, said tubes being connected at said throat, said venturi inlet tube having a cross-section transition from a circular cross-section to a rectangular cross-section at said throat, said venturi outlet tube having a rectangular cross-section extending from said throat to the inlet of said conveying duct and infeed means connected to said supplying means for feeding a tobacco material to said tubular venturi section.

2. The apparatus of claim 1, wherein said venturi inlet tube has a length at least three times the length of said venturi outlet tube.

3. The apparatus of claim 2, wherein said venturi inlet tube and said venturi outlet tube have coplanar bottom surfaces, said venturi inlet tube and said venturi outlet tube having upper surfaces which converge with the respective bottom surfaces thereof to said throat.

4. The apparatus of claim 1, wherein said infeed means comprises winnower means for accelerating the tobacco material into the gaseous medium flowing through said tubular venturi section.

5. The apparatus of claim 1, wherein said conveying duct has a non-circular cross-section from inlet to outlet.

6. The apparatus of claim 5, wherein said conveying duct has an intermediate cross-section, the cross-sectional area of said duct increasing from said inlet toward said intermediate cross-section and decreasing from said intermediate cross-section toward said outlet.

7. The apparatus of claim 5, wherein said conveying duct has a width-to-depth ratio of about 5 to 2.

8. The apparatus of claim 5, wherein said conveying duct has a rectangular or ovoid cross-section.

9. The apparatus of claim 1, including separator means connected to the outlet of the conveying duct for separating expanded tobacco material from the gaseous medium, said separator means having an inlet, and baffle means at the inlet of said separator means for adjusting the velocity of flow through said separator means.

10. Apparatus for expanding tobacco with a gaseous medium comprising a conveying duct for conveying the tobacco with the gaseous medium in said duct, said duct having an inlet and an outlet and defining a flow path having a flow direction from said inlet to said outlet, said duct comprising an intermediate section, a first duct section having a noncircular cross-section with an increasing cross-sectional area from said inlet toward said intermediate section and a second duct section from said intermediate section toward said outlet, said first duct section having a generally arcuate shape in side elevation from said inlet toward said intermediate section.

11. The apparatus of claim 10, wherein said second duct section has a non-circular cross-section with a gradually decreasing cross-sectional area from said intermediate section toward said outlet.

12. The apparatus of claim 11, wherein said second duct section has a generally arcuate shape in side elevation from said intermediate section toward said outlet.

13. The apparatus of claim 10, wherein said first duct section has a centerline defined in side elevation by a first large radius and said second duct section has a centerline defined in side elevation by a second large radius, said first and second duct sections being connected together to form said intermediate section.

14. The apparatus of claim 13, wherein said first large radius is greater than said second large radius.

15. The apparatus of claim 10, wherein the duct sections are oriented such that the flow directions at said inlet and said outlet are generally horizontal and the flow direction at said intermediate section is generally vertically upward.

16. The apparatus of claim 15, wherein said duct is generally C-shaped from said inlet to said outlet such that the flow direction at said inlet is opposite the flow direction at said outlet.

17. The apparatus of claim 10, wherein said intermediate section has a cross-sectional area about twice the cross-sectional area of said duct at said inlet and said outlet.

18. The apparatus of claim 10, wherein said duct has a substantially rectangular or ovoid cross-section with a width and a depth.

19. The apparatus of claim 18, wherein the width of said duct is substantially constant from said inlet to said outlet and the depth of said duct gradually increases from said inlet to said intermediate section and gradually decreases from said intermediate section to said outlet.

20. The apparatus of claim 19, wherein said duct has a width-to-depth ratio in the range of about 5 to 2.

21. The apparatus of claim 10, wherein the flow path of said conveying duct has a continuously varying flow direction from said inlet to said outlet.

22. A method of expanding tobacco impregnated with solid $CO_2$ comprising the steps of:

introducing the impregnated tobacco into a duct having a non-circular cross-section and an inlet and an outlet;

introducing a heated gaseous medium into the inlet of said duct at a flow rate and velocity and a temperature sufficient to expand the tobacco;

entraining substantially all the impregnated tobacco in the gaseous medium at said inlet;

flowing the gaseous medium with the entrained tobacco from said inlet toward said outlet along a generally arcuate flow path with a non-circular cross-section to sublime the solid $CO_2$ and expand the tobacco along said flow path;

decreasing the flow velocity of the gaseous medium and entrained tobacco from said inlet toward said outlet; and separating the expanded tobacco from the gaseous medium.

23. The method of claim 22, including, after the step of decreasing the flow velocity of the gaseous medium and entrained tobacco, the step of increasing the flow velocity of the gaseous medium and entrained tobacco toward said outlet.

24. The method of claim 22, wherein said non-circular cross-section is rectangular or ovoid.

25. The method of claim 24, wherein said flow path has a width-to-depth ratio of from about 5 to 2.

26. The method of claim 22, wherein the step of introducing the tobacco includes the step of accelerating the tobacco into the gaseous medium.

27. The method of claim 22, including the step of continuously changing the flow direction of the gaseous medium and entrained tobacco along said flow path from said inlet to said outlet by about 180°.

28. The method of claim 22, including the step of increasing the velocity of the gaseous medium prior to introducing the impregnated tobacco into the gaseous medium.

29. The method of claim 22, wherein said generally arcuate flow path has a substantially constant width.

30. The method of claim 22, including the step of adjusting the flow velocity of the gaseous medium with the entrained tobacco after it exits the generally arcuate flow path and before the separating step.

31. The method of claim 22, including the step of flowing the gaseous medium with the entrained tobacco in substantially horizontal directions at said inlet and said outlet and flowing the gaseous medium with the entrained tobacco in a substantially upwardly vertical direction intermediate said inlet and said outlet.

* * * * *